US010619122B2

(12) United States Patent
Desrosiers

(10) Patent No.: US 10,619,122 B2
(45) Date of Patent: Apr. 14, 2020

(54) CANDLE COMPRISING A FABRIC INFUSED WITH A WAX-BASED FORMULATION

(71) Applicant: ABEEGO DESIGNS INC., Victoria (CA)

(72) Inventor: Toni Marie Desrosiers, Victoria (CA)

(73) Assignee: ABEEGO DESIGNS INC. (CA)

( * ) Notice: Subject to any disclaimer, the term of this patent is extended or adjusted under 35 U.S.C. 154(b) by 38 days.

(21) Appl. No.: 15/902,182

(22) Filed: Feb. 22, 2018

(65) Prior Publication Data

US 2019/0256800 A1 Aug. 22, 2019

(51) Int. Cl.

| | |
|---|---|
| ***C11C 5/00*** | (2006.01) |
| ***C11C 5/02*** | (2006.01) |
| ***C06F 5/04*** | (2006.01) |

(52) U.S. Cl.

CPC ..... *C11C 5/008* (2013.01); *C06F 5/04* (2013.01); *C11C 5/002* (2013.01); *C11C 5/021* (2013.01)

(58) Field of Classification Search

CPC . C11C 5/002; C11C 5/008; C11C 5/00; C06F 5/04

See application file for complete search history.

(56) References Cited

U.S. PATENT DOCUMENTS 1,863,416 A * 6/1932 Root ..... C11C 5/00 431/288
2,026,572 A * 1/1936 Kempf ..... C22C 21/02 420/536
2,229,131 A * 1/1941 Root ..... C11C 5/00 264/246
5,955,034 A * 9/1999 Zaunbrecher ..... A01M 1/2066 422/126
2003/0134244 A1* 7/2003 Gray ..... C11C 5/008 431/288
2007/0006521 A1* 1/2007 Licciardello ..... C11C 5/008 44/275
2012/0202160 A1 8/2012 Ford
2013/0095440 A1* 4/2013 Cagle ..... F23D 3/08 431/325
2015/0041068 A1 2/2015 Cagle et al.
2018/0023034 A1* 1/2018 Han ..... C11C 5/006 44/275

FOREIGN PATENT DOCUMENTS

KR 20100059183 A * 6/2010

* cited by examiner

*Primary Examiner* — Latosha Hines
(74) *Attorney, Agent, or Firm* — Baumgartner Patent Law; Marc Baumgartner

(57) ABSTRACT

A wickless candle is provided, the candle comprising one or more sheets, the sheet including a first outer layer, a second outer layer and an inner layer therebetween to provide a thickness, the first outer layer and the second outer layer including a beeswax-based formulation, the inner layer including the beeswax-based formulation and a combustible substrate, the substrate including a plurality of fibers and a plurality of interstitial spaces between the fibers, the interstitial spaces retaining the beeswax-based formulation, wherein the beeswax-formulation in the interstitial spaces is continuous with the beeswax-based formulation of the first outer layer and the second outer layer.

15 Claims, 8 Drawing Sheets

CANDLE COMPRISING A FABRIC INFUSED WITH A WAX-BASED FORMULATION

FIELD

The present technology is directed to a wickless candle. More specifically, it is directed to a candle made from a fabric and beeswax-based formulation which substantially fills the interstitial spaces in the fabric. The candle can be modified by adding a match head to it.

BACKGROUND

Conventional candles contain a single wick. In these candles, the cross-sectional surface area of the wick is much smaller than the cross-sectional surface area of the candle itself. The conventional candle thus suffers from the problem of failing to provide sufficient heat so that the candle body burns evenly. Particularly, in candles contained in a container or vessel, the melt pool fails to reach the edge of the container. Larger candles and irregularly shaped candles with single wicks also suffer from this problem.

Further, conventional candles are limited because the flame created takes on the shape of the wick. Thus, the flame exists as a single point, and no aesthetic designs, shapes, or patterns can be created with the flame itself. The conventional wick, despite the use of rectangular, circular, or even a hollow wick, creates only a single point of light. A further drawback of the conventional candle is that the horizontal cross-sectional area of the wick is small compared to the horizontal cross-sectional area of the candle body.

Typical candles occasionally use multiple wicks, evenly placed throughout the candle body. Larger or irregularly shaped candles are often provided with these multiple wicks distributed in the candle body to provide sufficient heat for the candle wax to liquefy and burn. However, even these types of candles suffer from the same problems as discussed above because of the placement and use of multiple, conventional wicks in larger and irregularly shaped candles. Multiple wick use in a candle further suffers from the drawback that the melt pool created by each burning wick does not conform to the shape of the candle or the candle's container. The total cross-sectional area of the multiple wicks is still relatively small compared to the cross-sectional area of the candle, even when multiple wicks are used. Because of these deficiencies in the use of multiple conventional wicks, larger or irregularly shaped candles typically burn unevenly. Even these candles are limited in their aesthetic possibilities, as the flame shapes created by the multiple wicks appear simply as multiple points of light.

United States Patent Application 20120202160 discloses a candle that has a ribbon style wick disposed in the candle body so that the wick creates a shape in addition to the shape of the wick material itself. The shape created by the wick is an open or closed shape that may be geometric or organic. The body of the wick is surrounded by wax and, if a closed shape is created, the wax is disposed within the closed shape. Once lit, the flame of the candle then takes on the shape created by the placement of the wick. This does not address the problem of uneven burning, dripping wax, wax residues, and lack of resistance to being blown out by wind gusts or rapid movement.

United States Patent Application 20150041068 discloses a system and method for manufacturing a composite candle wick includes a mechanism for feeding the cotton wick and wood wick at substantially the same speeds. The wood wick is heated in order to cause a melting of a wax coating around the cotton wick and pressure is applied to the wick materials through a compression wheel and drive belt which carries the wick materials. Once the pressure is applied to form the composite wick the wicks are then sent through a cutting tube where a cutting blade will cut the wick to its desired length. The use of composite wicks does not address the problem of the candle being blown out by gusts of wind, nor does it address the problem of dripping wax and the resultant mess.

United States Patent Application 20130095440 discloses a rigid planar wick and one or more fabric wicks are adhered together for use in candles. The fabric wicks may be planar fabric wicks, traditional shaped string-shaped wicks or a fabric sheath. The rigid wick is of a predetermined width, length, and thickness and the planar fabric wick is of some dimension equal to, less than, or greater than the planar surface area of the rigid wick. By combining both a planar fabric wick and a rigid planar wick, consistency in flame heights can be achieved, providing an improved wick for candle use. This does not address the problem of the candle being blown out by gusts of wind, nor does it address the problem of dripping wax and the resultant mess.

What is needed is a candle that does not drip, and that has superior burning characteristics. It would be preferable if there was no wax residue left from burning the candle and little or no melt pool. It would be more preferable if the candle was resistant to being blown out by gusts of wind, or if moved quickly. It would be further preferable if the candle was composed of a lower percentage of wax as compared to conventional wax candles. It would be further preferable it the candle could be easily cut to provide a fresh, clean candle. It would be preferable if the candle could be provided in a variety of different shapes, while retaining the desired advantages.

SUMMARY

The present technology is an essentially dripless candle. It has superior and controlled burning characteristics and little or no melt pool as substantially all of the first surface of the candle is the burning surface. Hence, if a small point flame is desired, a small point of the candle is at the first surface. Alternatively, should a larger and perhaps broad flame be desired, the first surface of the candle is larger and broader. The candle is resistant to being blown out. It has a lower percentage of wax and a lower ratio of wax to wick as compared to conventional wax candle. The candle can easily be cut to provide a fresh, clean candle. The candle can be molded in a variety of shapes, as the layers of the candle adhere to one another.

In one embodiment a wickless candle is provided, the candle comprising one or more sheets formed into a three-dimensional shape, the sheet including: a first outer layer; a second outer layer; and an inner layer therebetween to provide a thickness, the first outer layer and the second outer layer including a beeswax-based formulation, the inner layer including the beeswax-based formulation and a combustible substrate, the substrate including a plurality of fibers and a plurality of interstitial spaces between the fibers, the interstitial spaces retaining the beeswax-based formulation, wherein the beeswax-formulation in the interstitial spaces is continuous with the beeswax-based formulation of the first outer layer and the second outer layer.

In the wickless candle, the beeswax-based formulation may comprise about 35% to about 60% by weight of the candle.

In the wickless candle, the beeswax-based formulation may comprise beeswax, tree resin, and Jojoba oil.

In the wickless candle, the substrate may be a fabric or a cellulosic layer.

In the wickless candle, the substrate may be the fabric.

In the wickless candle, the beeswax-based formulation may comprise about 30% to about 50% by weight beeswax, about 9% to about 24% by weight tree resin and about 3% to about 10% by weight Jojoba oil.

In the wickless candle, the inner layer may comprise between about 70% to about 90% of the thickness of the sheet.

In the wickless candle, the one or more sheets may be one or more strips.

In the wickless candle, one or more strips may be twisted.

In the wickless candle, two or more strips may be braided.

In the wickless candle, the sheets may be laminated into a block.

In the wickless candle, the block may be a ball.

In the wickless candle, the block may be a rectangle.

In the wickless candle, the block may be a taper.

In the wickless candle, the block may be a pyramid.

In another embodiment, a method of manufacturing a wickless candle is provided, the method comprising selecting a combustible substrate which has interstitial spaces, filling the interstitial spaces with a beeswax-based formulation to provide an inner layer, coating the inner layer with a thin first outer layer on a first side and a thin second outer layer on a second side to provide one or more sheets, and shaping one or more sheets into a three-dimensional shape, thereby manufacturing a wickless candle.

In the method, the beeswax-based formulation may comprise about 30% to about 50% by weight beeswax, about 9% to about 24% by weight tree resin and about 3% to about 10% by weight Jojoba oil.

In the method, the inner layer is coated such that the thin first outer layer and the second thin outer layer may comprise between about 10% to about 30% of the thickness of the sheet.

The method may further comprise cutting the sheet into one or more strips.

The method may further comprise twisting the one or more strips.

The method may further comprise braiding two or more strips.

The method may further comprise laminating the sheets into a block.

In the method the block may be a ball.

In the method the block may be a rectangle.

In the method the block may be a taper.

In the method the block may be a pyramid.

In another embodiment, a match is provided, the match comprising: one or more sheets formed into a three-dimensional shape, the three-dimensional shape having a first end, a second end and a length therebetween, the sheet including a first outer layer, a second outer layer and an inner layer therebetween to provide a thickness, the first outer layer and the second outer layer including a beeswax-based formulation, the inner layer including the beeswax-based formulation and a combustible substrate, the substrate including a plurality of fibers and a plurality of interstitial spaces between the fibers, the interstitial spaces retaining the beeswax-based formulation, wherein the beeswax-formulation in the interstitial spaces is continuous with the beeswax-based formulation of the first outer layer and the second outer layer; and a mass of ignition material, the mass of ignition material either coating the first end to provide a match head, or embedded in the first end.

In the match the three-dimensional shape may be a cylinder.

In the match the ignition material may be the match head.

FIGURES

FIG. 4A shows a spiral candle;

FIG. 4B shows a helical candle;

FIG. 4C shows a candle made from three strips;

FIG. 4D shows a braided candle.

Figure 7A:
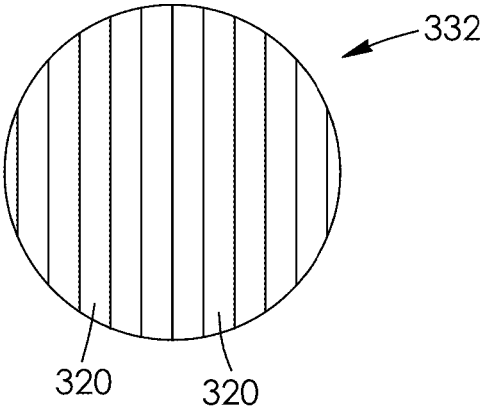
Figure 7B:
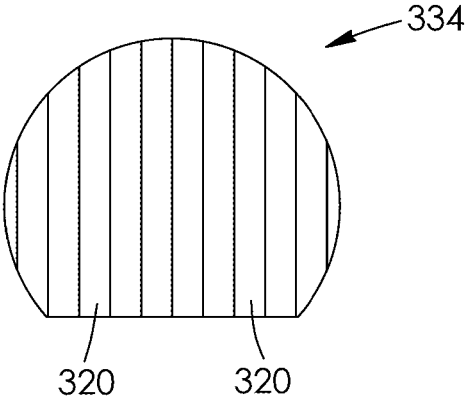
Figure 7C:
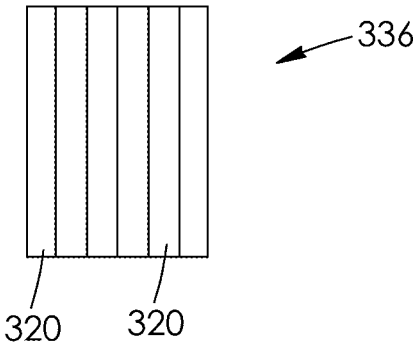
Figure 7D:
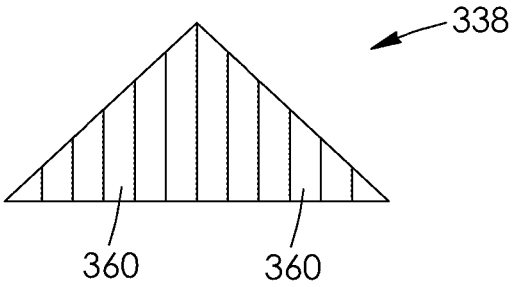
Figure 7E:
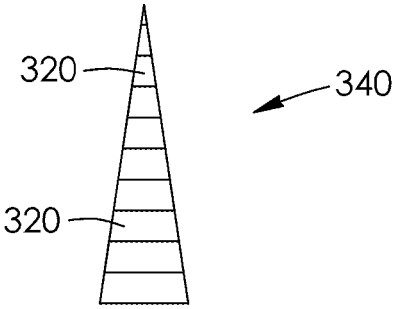

FIGS. 7A-E show exemplary shapes of candles made from a stack of sheets. FIG. 7A is ball shaped candle;

FIG. 7B is a flat-bottomed ball shaped candle;

FIG. 7C is a rectangular-shaped candle;

FIG. 7D is a triangular shaped candle;

FIG. 7E is a tapered candle.

Figure 8:
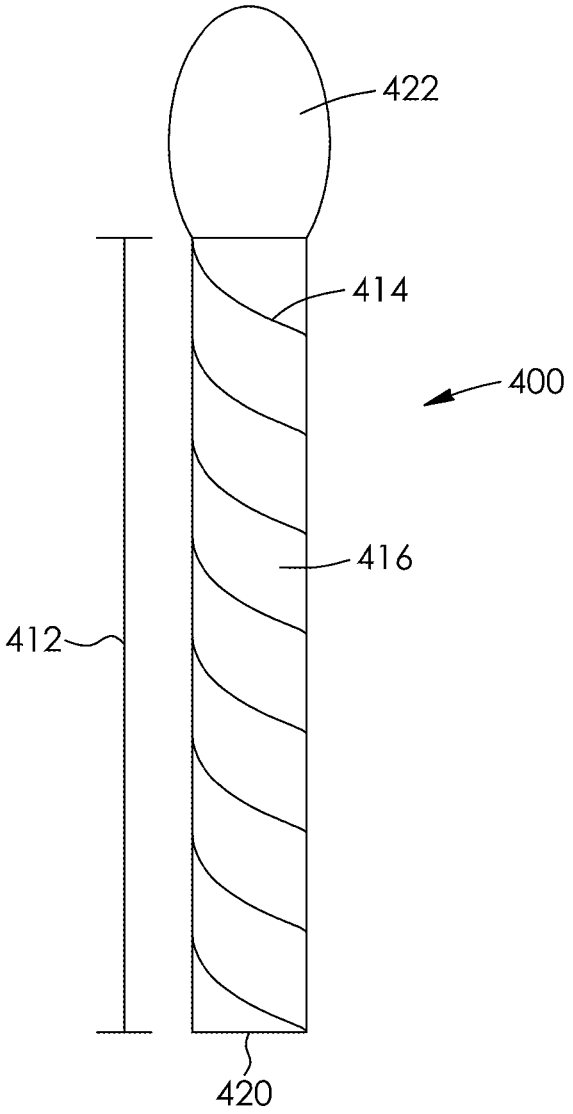

FIG. 8 is match of the present technology

Figure 9:
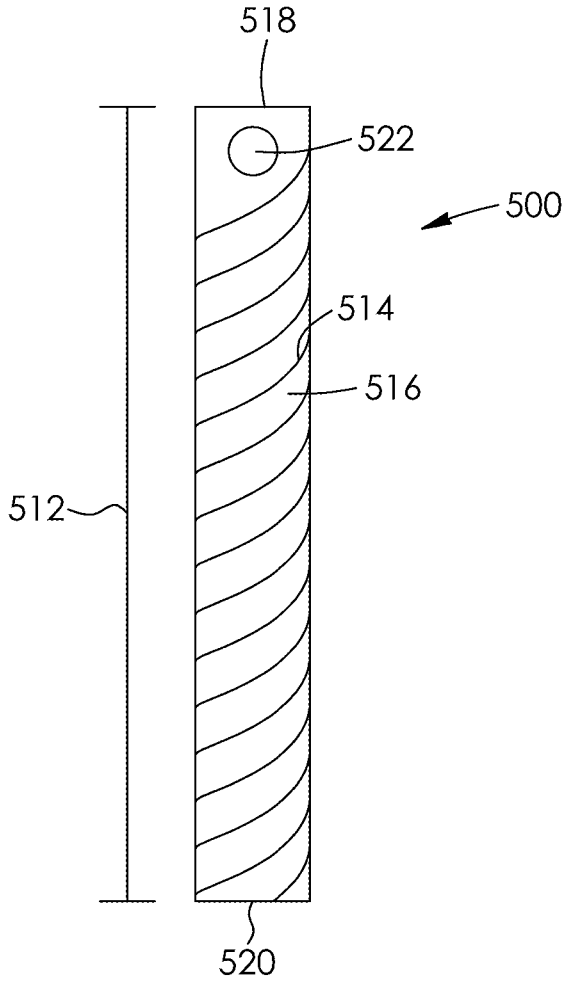

FIG. 9 is a longitudinal sectional view of an alternate embodiment of the match of FIG. 8.

DESCRIPTION

Except as otherwise expressly provided, the following rules of interpretation apply to this specification (written description and claims): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms "comprising," "having," "including," and "containing" are to be construed as open ended terms (i.e., meaning "including, but not limited to,") unless otherwise noted.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

Definitions

Beeswax—The main components are palmitate, palmitoleate, and oleate esters of long-chain (30-32 carbons) aliphatic alcohols, with the ratio of triacontanyl palmitate CH3(CH2)29O—CO—(CH2)14CH3 to cerotic acid CH3(CH2)24COOH, the two principal components, being 6:1. Beeswax can be classified generally into European and Oriental types. The saponification value is lower (3-5) for European beeswax, and higher (8-9) for Oriental types.

Beeswax has a relatively low melting point range of 62 to 64° C. (144 to 147° F.). If beeswax is heated above 85° C. (185° F.) discoloration occurs. The flash point of beeswax is about 204.4° C. (400 to 470° F.). Density at 15° C. is 958 to 970 kg/$m^3$.

Natural beeswax—When cold it is brittle; at ordinary temperatures it is tenacious; its fracture is dry and granular. The sp. gr. at 15° C. is from 0.958 to 0.975, that of melted wax at 98°-99° compared with water at 15.5° is 0.822. It softens when held in the hand, and melts at 62°-66°; it solidifies at 60.5°-63° C.

Cellulosic sheet—These are meant to include any product incorporating papermaking fibre having cellulose fibres as a major constituent. Cellulose fibres are naturally occurring fibres, as opposed to regenerated fibres such as lyocell or rayon that are liberated from their source material by any one of a number of pulping processes. "Papermaking fibres" include virgin pulps, recycle (secondary) cellulosic fibres, or cellulosic fibres. The papermaking fibres include those obtained from deciduous and coniferous trees, including softwood fibres, such as fir, pine, spruce and the like, and hardwood fibres, such as eucalyptus, maple, birch, aspen, and the like. The papermaking fibres may also include cellulosic fibres such as cotton, hemp, linen, and sisal. The papermaking fibres may also include cellulosic fibres from monocots and non-secondary growth plants. The cellulosic sheet includes Kraft paper. It has interstitial spaces.

Fabric—in the context of the present technology, a fabric includes knits and weaves of fibres such as, but not limited to nylon, rayon, carbon fibre, silk, mechanically processed bamboo (bamboo linen), bamboo, cotton, hemp, linen, sisal, hardwood fibre, softwood fibre and mixtures thereof.

Natural fabric—in the context of the present technology, natural fabric includes knits and weaves of silk and of plant derived fibres, such as, but not limited to cotton, jute, kenaf, hemp, linen, sisal, hardwood fibre, mechanically processed bamboo (bamboo linen), softwood fibre, herbaceous dicot fibres and monocot fibres and mixtures thereof. Natural fabric does not include fabrics from regenerated fibres.

Jojoba oil—This is a liquid wax ester from seeds of the seed of the *Simmondsia chinensis* plant. It has not been saponified. The melting point of jojoba oil is approximately 10° C. and the iodine value is approximately 80. It has a viscosity of 48 cSt at 99° C. and 127 cSt at 37.8° C. it is composed largely of 11-Eicosenoic Acid (C20:1) [30.3%], Docosenoic Acid (C22:1) [14.2%], Docosdienoic acid (C22:2) [33.7%] and 9-Godoelic Acid (C20:1) [14.6%]. There are no trigycerides. Other oils sharing the characteristics of jojoba oil are suitable substitutes, with viscosity, melting point and a high percentage of long, relatively straight chain fatty acids, with one or two double bonds and a lack of trigycerides being the more important characteristics for the present technology.

Tree resin—The preferred resin is from the Damar tree and is referred to also as Damar gum. Without being bound to theory, the tree resin increases the melting point of the wax and adds to the adhesive qualities when mixed with the oil. The damar crystals melt at about 225° C. The resin is obtained from the Dipterocarpaceae family, principally those of the genera Shorea, Balanocarpus or Hopea. Other resins or exudates from plants and trees that provide the desired traits can be used wholly or in part as substitutes, for example, resin from the copal tree, Protium copal (Burseraceae) or the mastic tree, Pistacia lentiscus or sandarac from the Tetraclinis articulata tree may substitute for the Damar tree. Accordingly the term "tree resin" refers to any of the above mentioned resins or combinations thereof. Up to about 5% candelilla or carnauba wax may be included in any of the resins or mixtures thereof.

Wick—in the context of the present technology, a wick is a bundle or loose twist or braid of soft threads, or a woven strip or tube, as of cotton or asbestos, which in serves to draw up the melted tallow or wax or the oil or other flammable liquid to be burned.

Wickless—in the context of the present technology, wickless refers to a candle in which wicking of melted wax or other flammable liquid to be burned is reduced or substantially eliminated. It can also be understood to be a candle in which there is no defined waxless bundle or loose twist or braid of soft threads, or a woven strip or tube. It can also be understood to be a candle in which the wax formulation substantially fills the interstitial spaces in a substrate.

Three-dimensional shape—in the context of the present technology, a three dimensional shape is any shape that can be made using what is loosely referred to as a two dimensional sheet. A three dimensional shape is, for example, but not limited to, a ball, a cylinder, a pyramid, a block, a ball or a taper.

DETAILED DESCRIPTION

Figure 1:
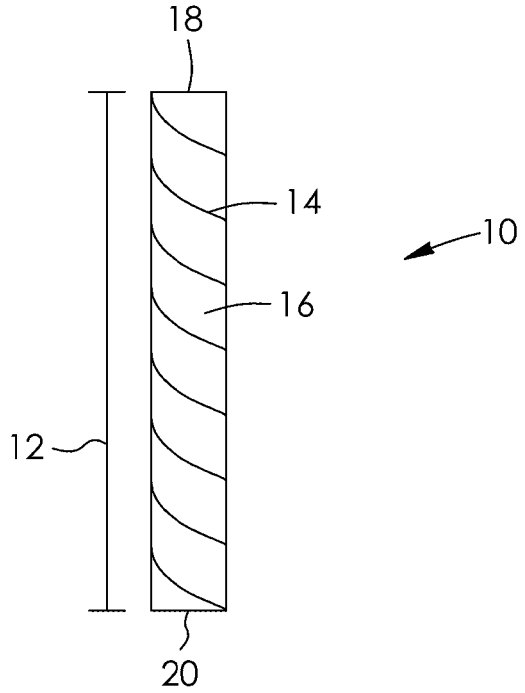
FIG. 1 is a side view of a candle of the present technology.
Figure 2A:
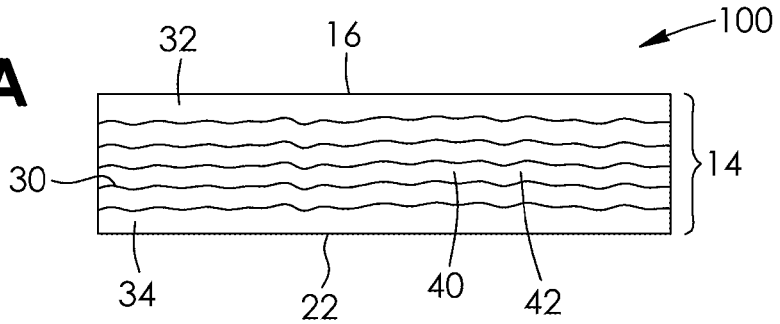
FIG. 2A is a schematic of a cross section through the sheet of the candle of FIG. 1.
Figure 2B:
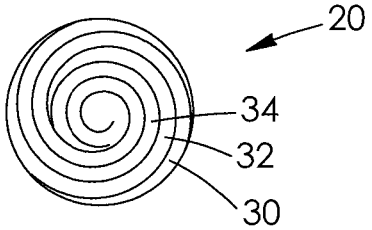
FIG. 2B is an end view of the candle.
Figure 2C:
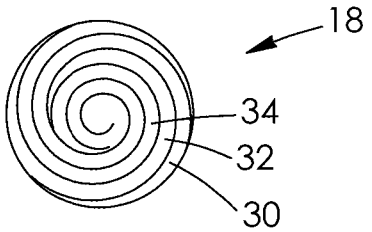
FIG. 2C is a view of the other end.
Figure 2D:
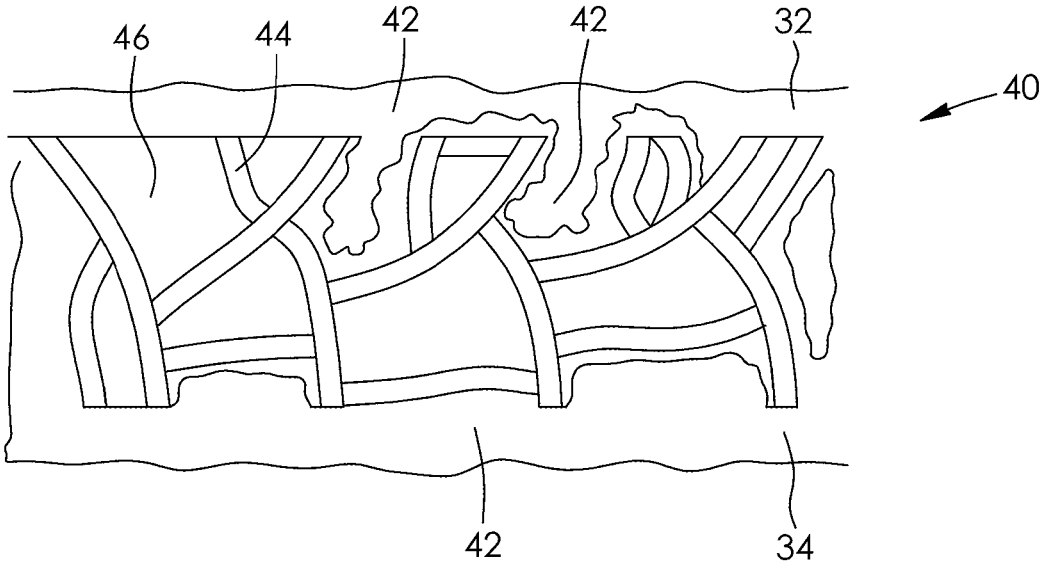
FIG. 2D is a close-up schematic of the fabric with the formulation.

A candle, generally referred to as 10 is shown in FIG. 1. It has a length, generally referred to as 12, which has an edge 14 and a first surface 16. In the embodiment shown, the edge 14 spirals. The top end of the length 12 is the burning end 18, which is opposite to the bottom end 20. As shown in FIG. 2A, the candle is made from a sheet, generally referred to as 100 which also has the edge 14, the first surface 16 and a second surface 22. The edge 14 has an inner layer 30, a first outer layer 32, and a second outer layer 34. The inner layer 30 includes a planar substrate 40 and a formulation 42. As shown in FIG. 2B, the bottom end 20 is flat and has the inner layer 30, the first outer layer 32 and the second outer layer 34 with their respective surfaces as shown in FIG. 2A. As shown in FIG. 2C, the burning end 18 has the inner layer 30, the first outer layer 32, the second outer layer 34, with their respective surfaces as shown in FIG. 2A. The combustible substrate 40 is preferably a fabric that provides structural support for the formulation 42. The fabric is preferably a natural fabric. As shown in FIG. 2D, the formulation 42 may sandwich, coat, impregnate, infiltrate, partially coat, cover, partially cover, or infuse the fibres 44 of the fabric 40. It substantially fills the interstitial spaces 46. The formulation 42 in the first outer layer 32 and the second outer layer 34 is continuous with the formulation in the interstitial spaces 46. Ideally, both the first surface 16 and the second surface 22 are composed in their entirety of the formulation 42, but the fabric 40 may also form part of either or both surfaces 16,22. Superior adhesion between the first and second surface 16, 22 is obtained by ensuring that the entire first surface 16 and the entire second surface 22 are composed of the formulation 42. If there is partial coverage of the surfaces with the formulation, then the adhesion will be inferior. As would be apparent, if two surfaces that lack the formulation are pressed together, there will be no adhesion. The first and second outer layers 32, 34 need only be thick enough to form the first and second surface 16, 22. The candle 10 has no defined wick.

The formulation 42 is made of beeswax, Damar resin, and Jojoba oil. A mixture of these components is heated and the substrate is infused and/or impregnated and coated with the mixture. The formulation is applied to the substrate using either wet waxing or dry waxing techniques.

The preferred fabrics are made with natural fibres, such as knits and weaves of, for example, but not limited to cotton, hemp, linen, sisal, silk and mixtures thereof. The preferred fabric weight is about 3.5 ounces to about 5.4 ounces. The thread count is preferably about 100 to about 300.

The formulation 42 is about 35% to about 60% of the weight of the sheet, preferably 50%. In a preferred embodiment, the fabric is muslin. The sheet 100 is about 0.30 mm thick with the first outer layer 32 being about 0.05 mm thick and the second outer layer being about 0.05 mm thick and the inner layer 30 being about 0.25 mm thick. Thus, the inner layer 30 comprises at least about 75% of the thickness of the sheet 100 and not more than about 90% of the thickness of the sheet 100. The formulation is about 30% to about 50% tree resin, and about 50% to about 70% beeswax, preferably about 30% tree resin, and about 70% beeswax. It is preferred that the tree resin is Damar resin.

In another embodiment, a cellulosic layer, with interstitial spaces is used as the substrate 40 instead of fabric. Again, the formulation 42 is about 35% to about 60% of the weight of the sheet, preferably 50%. The formulation is about 30% to about 50% tree resin, and about 50% to about 70% beeswax, preferably about 30% tree resin, and about 70% beeswax. It is preferred that the tree resin is Damar resin.

Figure 3:
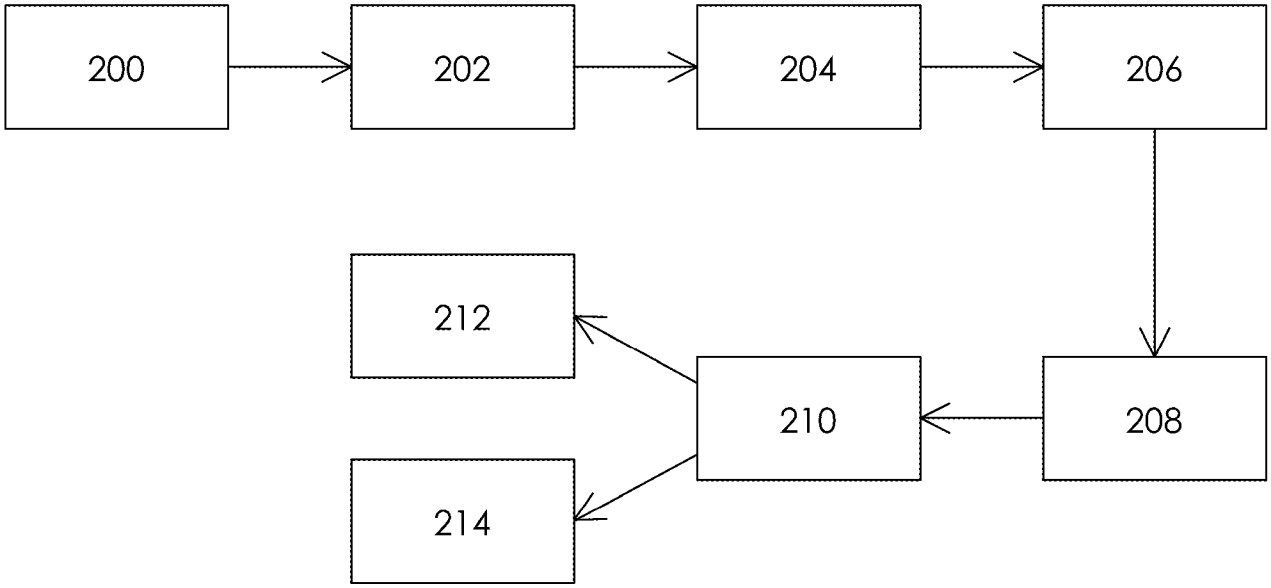
FIG. 3 is a block diagram of the method of manufacturing the sheet of the candle of FIG. 1.

The method of producing the sheet 100 is shown in FIG. 3. The components of the formulation are weighted 200, placed in a container 202, heated 204 until the components have melted, and mixed 206. For the sheets 100, the cellulosic layer or fabric layer is then fed 208 through the molten mixture and is allowed to cool 210 before being rolled 212 on to a core. Alternatively, the sheet 100 is simply provided as single units or are stacked 214.

Figure 4A:
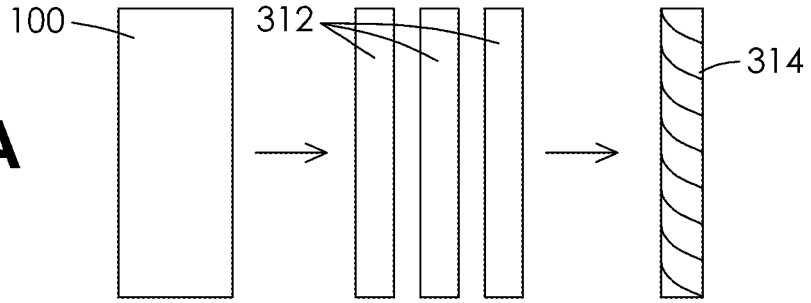
FIGS. 4A-4D show different candles made from strips of sheet.
Figure 4B:
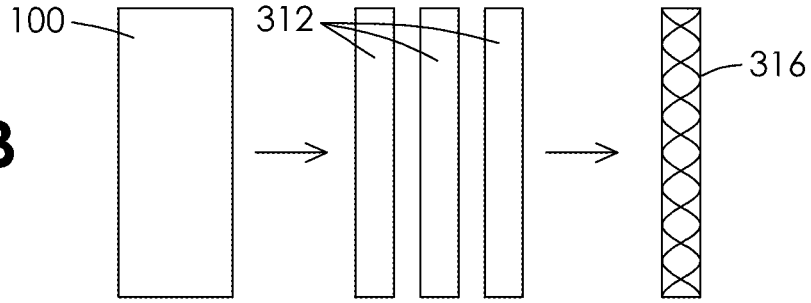
Figure 4C:
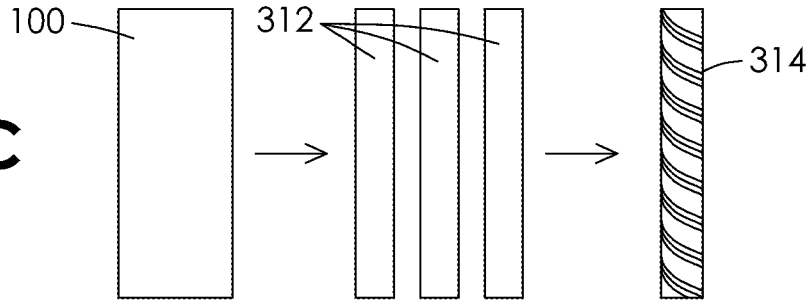
Figure 4D:
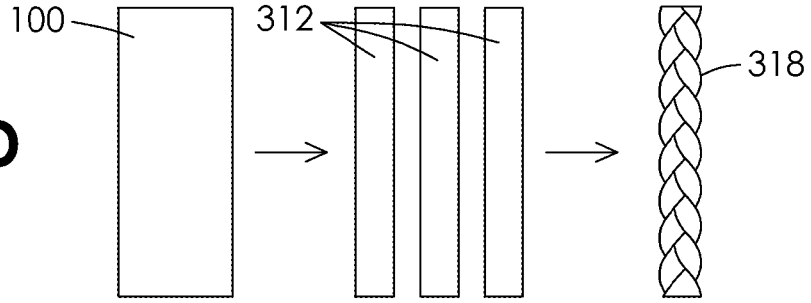

As shown in FIG. 4A-D, a candle 10 can be prepared from the sheet 100 in a number of ways. As shown in FIG. 4A, the candle 10 is made by cutting the sheet 100 into thins strips 312, and twisting a single thin strip into a spiral 314, to provide a thin candle 10, suitable for a birthday candle. As shown in FIG. 4B, the candle 10 is again made by cutting the sheet 100 into thins strips 312, and twisting two thin strips into a helix 316 or spiral 314 to provide a thicker candle. As shown in FIG. 4C, the candle 10 is again made by cutting the sheet 100 into thin strips 312, and twisting three or more thin strips in a spiral 314 or helix 316 or, as shown in FIG. 4D, or braiding two or more thin strips into a braid 318.

Figure 5A:
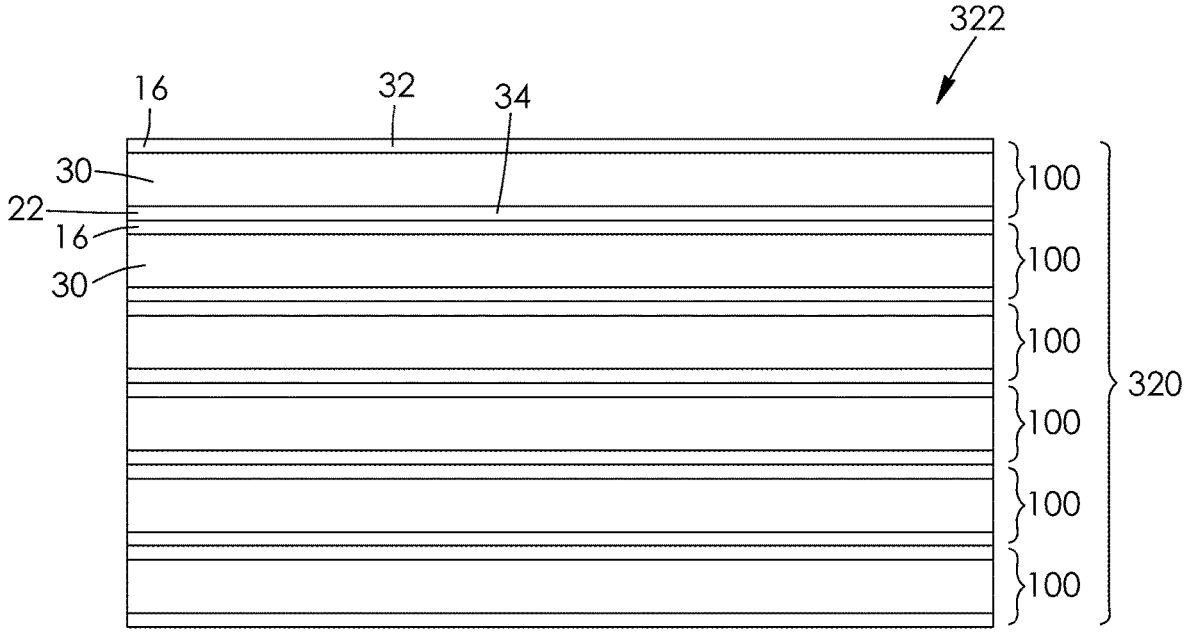
FIG. 5A shows a stack of sheets for making a candle.
Figure 5B:
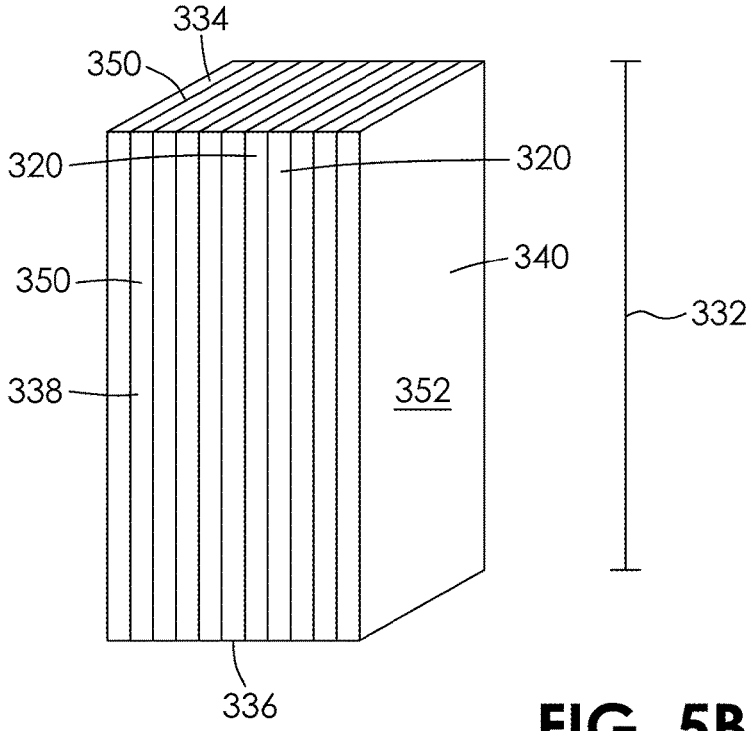
FIG. 5B shows an exemplary candle made from the stack of sheets.

As shown in FIG. 5A, the candle 10 is made by laminating a plurality of sheets 100 in a plurality of layers 320, which are then pressed together to form a block 322. A hydraulic press is used to press the first surface 16 of one layer 320 to the second surface 22 or first surface 16 of another layer 320. The block 322 can be used as a candle 10, as is, or can be later cut into different shapes. As shown in FIG. 5B, it has a length 332, a top 334, a bottom 336, two laminate sides 338 and two coated sides 340. The top 334, the bottom 336 and the two laminate sides 338 have the edge 350 of the sheet 100 exposed. The two coated sides 340 have a surface 352 comprising the formulation 42, as they are the first and last layer of the sheet. The top 334 is the burning end.

Figure 6:
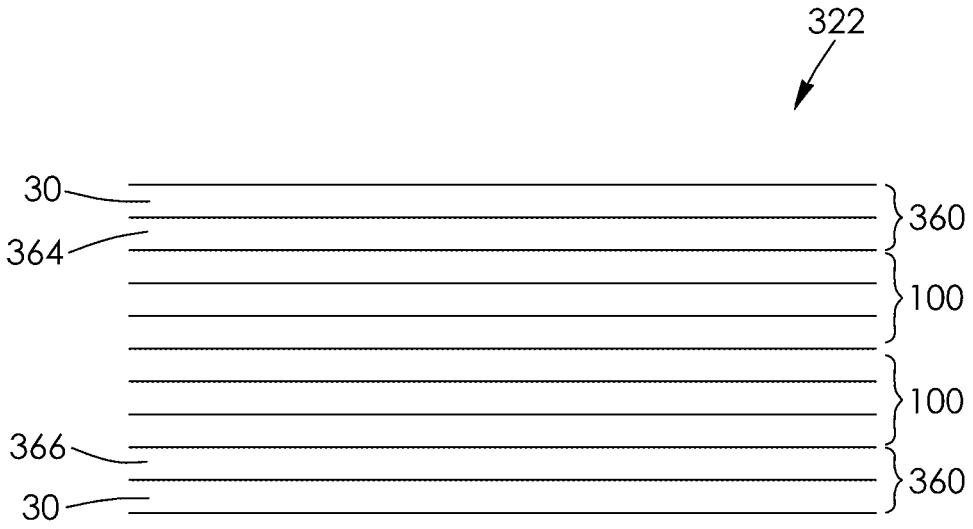
FIG. 6 shows an alternative embodiment of FIG. 5B.

In an alternative embodiment, shown in FIG. 6, the first layer 360 of the sheet 100 and the last layer 362 of the sheet are coated on one side. The second side 364 of the first layer 360 is coated and the first side 366 of the second layer 362 is coated.

As shown in FIGS. 7A-E, the layers 320 can be provided in various shapes, such as round, and increasing and then decreasing diameter to produce a block 322 that is a ball 332 (FIG. 7A), hemispherical and increasing and then decreasing in diameter to produce a block 322 that is a flat-bottomed ball 334 (FIG. 7B) a block 322 that is rectangular to produce a rectangular candle 336 (FIG. 7C), a block 322 that is triangular to produce a pyramidal candle 338 (FIG. 7D), round and decreasing in diameter to form a block 322 that is a taper 340 (FIG. 7E) and the like.

As shown in FIG. 8, in an alternative embodiment, a match, generally referred to as 400 is provided. The match has a length 412 which has an edge 414 and a first surface 416. In the embodiment shown, the edge 414 spirals. The top end of the length 412 is the match head 422, which is opposite to the bottom end 420. The method of preparing the match 400 is as described above and is as shown in FIGS. 4A-D, thus the match 400 may be a three-dimensional shape such as spiral, helical, twisted, braided and the like. It may also be pressed into the three-dimensional shape as described in relation to FIG. 7A-E. Once the length 412 is prepared, one end is dipped in the ignition material to provide the match head 422. The ignition material may be any ignition material that can be coated on the end of the match, including but not limited to white phosphorus, phosphorus sesquisulfide and potassium chlorate, mixed with sulfur, fillers and glass powder. The match head 422 may be coated in a wax, for example, but not limited to paraffin wax or the wax formulation of the present invention.

As shown in FIG. 9, a match, generally referred to as 500, has a length 512 extending between a top end 518 and a bottom end 520. Proximate the top end 518 is a small mass of ignition material 522. The method of preparing the match 500 is as described above and is as shown in FIGS. 4A-D, thus the match 500 may be a three-dimensional shape such as spiral, helical, twisted, braided and the like. It may also be pressed into the three-dimensional shape as described in relation to FIG. 7A-E. The mass of ignition material 522 is located proximate the top end 518 and the match 500 is formed around it. The ignition material may be any ignition material that can be embedded into the end of the match, including but not limited to white phosphorus, phosphorus sesquisulfide and potassium chlorate, mixed with sulfur, fillers and glass powder. The match is waterproof in its entirety, unlike a standard "waterproof" match, which is only waterproof at the match head.

The match 400, 500 can be lit by pressing the match head 422 or top end 522 on a suitable striker surface or by drawing the match head 422 or top end 522 between suitable striker surfaces. Once lit, the match 400, 500 will continue to burn for an extended time period and can be placed on the wood or other combustible material to assist in starting a fire. A match 400, 500 the same size of a standard wood match (6 cm long by 2 mm in diameter) will burn for at least about 2 minutes to at least about 5 minutes, as compared to about 30 seconds for a standard wood match.

In all candles and matches, the ratio of substrate to formulation remains the same. The substrate has interstitial spaces and the formulation is retained in the interstitial spaces. The formulation also forms a thin layer on either side of the substrate, which is continuous with the formulation in the interstitial spaces. The fibers of the substrate may also be infiltrated or infused with the formulation. Thus, there is no discrete region or zone of the candle that is without the formulation and which could therefore be considered to be a wick.

While example embodiments have been described in connection with what is presently considered to be an example of a possible most practical and/or suitable embodiment, it is to be understood that the descriptions are not to be limited to the disclosed embodiments, but on the contrary, is intended to cover various modifications and equivalent arrangements included within the spirit and scope of the example embodiment. Those skilled in the art will recognize, or be able to ascertain using no more than routine experimentation, many equivalents to the specific example embodiments specifically described herein. Such equivalents are intended to be encompassed in the scope of the claims, if appended hereto or subsequently filed.

The invention claimed is:

1. A wickless candle, the candle comprising a plurality of sheets formed into a three-dimensional shape, each sheet including: a first outer layer; a second outer layer; and an inner layer therebetween to provide a thickness, the first outer layer including a beeswax-based formulation and the second outer layer including the beeswax-based formulation, the inner layer including the beeswax-based formulation and a planar combustible substrate, the planar combustible substrate including a plurality of fibers and a plurality of interstitial spaces between the fibers, and the interstitial spaces retaining the beeswax-based formulation, wherein the beeswax-formulation in the interstitial spaces is continuous with the beeswax-based formulation of the first outer layer and the second outer layer.

2. The wickless candle of claim 1, wherein the beeswax-based formulation comprises about 35% to about 60% by weight of the candle.

3. The wickless candle of claim 2, wherein the beeswax-based formulation comprises beeswax, Damar resin, and Jojoba oil.

4. The wickless candle of claim 1, wherein the planar combustible substrate is a fabric or a cellulosic layer.

5. The wickless candle of claim 4, wherein the planar combustible substrate is the fabric.

6. The wickless candle of claim 5, wherein the beeswax-based formulation comprises about 30% to about 50% by weight beeswax, about 9% to about 24% by weight Damar resin and about 3% to about 10% by weight Jojoba oil.

7. The wickless candle of claim 1, wherein the inner layer comprises between about 70% to about 90% of the thickness of each sheet.

8. The wickless candle of claim 7, wherein the sheets are laminated into a block.

9. The wickless candle of claim 8 wherein the block is a ball.

10. The wickless candle of claim 8, wherein the block is a rectangle.

11. A method of manufacturing a wickless candle, the method comprising selecting a planar combustible substrate which has interstitial spaces, filling the interstitial spaces with a beeswax-based formulation to provide an inner layer, coating the inner layer with a thin first outer layer of the beeswax-based formulation on a first side and a thin second outer layer of the beeswax-based formulation on a second side such that the beeswax-formulation in the interstitial spaces is continuous with the beeswax-based formulation of the first outer layer and the second outer layer, to provide one or more sheets, and shaping the one or more sheets into a three-dimensional shape, thereby manufacturing a wickless candle.

12. The method of claim 11, wherein the inner layer is coated such that the thin first outer layer and the second thin outer layer comprise between about 10% to about 30% of the thickness of the sheet.

13. The method of claim 12, further comprising cutting the sheet into one or more strips and twisting the one or more strips.

14. The method of claim 13, further comprising laminating the sheets into a block.

15. The method of claim 11, wherein the beeswax-based formulation comprises about 30% to about 50% by weight beeswax, about 9% to about 24% by weight Damar resin and about 3% to about 10% by weight Jojoba oil.

* * * * *